United States Patent [19]

Fogarty

[11] 4,220,191

[45] Sep. 2, 1980

[54] METHOD OF CONTINUOUSLY CASTING STEEL

[75] Inventor: John E. Fogarty, Burlington, Canada

[73] Assignee: Slater Steel Industries Limited, Ontario, Canada

[21] Appl. No.: 971,564

[22] Filed: Dec. 20, 1978

Related U.S. Application Data

[63] Continuation of Ser. No. 736,495, Oct. 28, 1976, abandoned.

[30] Foreign Application Priority Data

May 17, 1976 [GB] United Kingdom ..... 20260/76

[51] Int. Cl.[3] ..... B22D 27/20

[52] U.S. Cl. ..... 164/57; 164/82

[58] Field of Search ..... 164/55, 56, 57, 122, 164/123, 82; 75/33, 56, 58

[56] References Cited

U.S. PATENT DOCUMENTS

| | | | |
|---|---|---|---|
| 2,882,571 | 4/1959 | Easton | 164/56 |
| 3,314,782 | 4/1967 | Arnaud | 75/58 X |
| 3,926,246 | 12/1975 | Corbett et al. | 164/56 |
| 4,035,892 | 7/1977 | Ototani et al. | 75/58 X |

FOREIGN PATENT DOCUMENTS

| | | | |
|---|---|---|---|
| 99931 | 9/1974 | Japan | 164/55 |

*Primary Examiner*—Robert D. Baldwin
*Assistant Examiner*—Gus T. Hampilos
*Attorney, Agent, or Firm*—Cushman, Darby & Cushman

[57] ABSTRACT

A method of continuously casting steel in an open-bottom mould, with an addition of aluminum to molten steel, as the latter enters the mould, includes the addition of a fluxing agent to the molten steel, as the latter enters the mould, to fluidize viscous slags and thereby to mitigate detrimental surface characteristics which would otherwise be produced in the steel, when cast, as a result of such slags. Preferably, the fluxing agent is a metal oxide, e.g. manganese oxide, silicon oxide, boron oxide or sodium oxide, or a mixture of metal oxides, provided as a coating on an aluminum wire, which wire may constitute the aluminum addition. The invention further includes a steel additive comprising such a coated aluminum wire.

2 Claims, 2 Drawing Figures

METHOD OF CONTINUOUSLY CASTING STEEL

This is a continuation of application Ser. No. 736,495 filed Oct. 28, 1976, now abandoned.

BACKGROUND OF THE INVENTION

1. Field of the Invention

The present invention relates to a method of continuously casting steel in an open-bottom mould, and to steel additives for use in such methods, and is applicable in particular to the continuous casting of steel containing aluminum.

2. Description of the Prior Art

Aluminum is commonly added to steel in quantities up to 0.20% to enhance the soundness and refinement of the steel structure and thereby to impart improved mechanical properties. Such additions are normally made while the molten steel is in a steel-making furnace, or during or after it has been transferred into a pouring ladle, or while the molten steel is being poured into ingot moulds just prior to final solidification of the steel ingots.

The solid steel ingots containing the aluminum are then normally hot-worked (rolled or forged, for example) into steel slabs or blooms or billets in preparation for further hot or cold processing into smaller steel sections (plate, sheet, bars, rod, etc.), or into special steel sections or parts.

A relatively recent approach to the production of slabs, blooms, or billets involves the transfer of molten steel directly into water-cooled metal moulds so as to directly produce solid slab, bloom or billet shapes. The manufacturing steps of producing ingots and the hot-working of the ingots into slabs, blooms, or billets are therefore circumvented.

This continuous casting approach is now common throughout the world and is generally referred to as continuous-casting or strand-casting. In the simplest sense, it involves the continuous withdrawal of steel from the bottom of open-bottomed water-cooled moulds as the steel solidifies. Molten steel is concurrently added into the top of the mould in support of the withdrawal rate. In other words, while molten steel is continuously added into the top of the mould, the solidified slab, bloom, or billet strand section is continuously withdrawn through the open bottom of the mould at the same rate.

For continuous casting, steel is melted, processed, and transferred into a pouring ladle in much the same way as if the steel were to be poured into ingot moulds. However, at continuous casting, the molten steel from the ladle normally passes through a trough or tundish during passage to the continuous casting moulds, while during ingot mould casting, the molten steel passes directly from the ladle into the ingot moulds. The tundish provides a reservoir whose purpose is to promote a precisely directed, controlled, splash-free stream of molten metal to the continuous casting mould. For this purpose the tundish is fitted with one or more nozzles depending on the number of continuously cast strands that are to be cast simultaneously.

The flow rate of the molten metal into the water-cooled moulds can be controlled by the use of stoppering or other devices which can constrict the nozzle openings. The flow can be stopped and started by, for example, placing the stopper head over the nozzle opening, and then removing it.

It is often more convenient not to use devices to constrict the flow of molten metal through the relatively large nozzles, but rather to provide smaller nozzle openings which are sized to automatically provide or meter the required flow rate. However, these smaller nozzle openings, which are often less than 1" in diameter, can foster flow problems if the steel contains aluminum. Aluminum in the steel tends to form a solid deposit of its compounds along the nozzle wall. The deposit thickness can increase sufficiently to significantly reduce in size the effective nozzle opening, thereby destroying the necessary metered flow-rate.

To circumvent this problem, yet accommodate the benefits of both smaller metering nozzles and aluminum containing steel, the aluminum addition is often added to the molten steel in the form of mechanically fed aluminum wire after the steel emerges from the tundish nozzle during its fall into the continuous casting mould.

Unfortunately, this method of making aluminum additions to continuously cast steel can detract from the external quality of the strand sections being cast, as discussed hereinafter.

During the continuous casting of molten steel to which no aluminum addition has been made, many of the metallic elements in steel, i.e. manganese, silicon, iron, etc., react with the environment to form a molten slag of the oxides of these elements. This substance is often present on the surface of the molten metal in the water-cooled mould of the continuous caster. However, because this slag is generally very fluid and because it solidifies at temperatures several hundreds degrees below that of the molten steel, it tends to harmlessly be washed in between the wall of the water-cooled mould and the surface of the solidifying section being cast. A thin film of this substance becomes attached to the surface of the solidified continuously-cast steel strand. It has minimal influence on the surface quality of the solidified steel strands.

However, when aluminum is added to the molten steel as it emerges from the tundish nozzle and before it enters the water-cooled mould, it causes the very fluid slag on the molten steel to change into a viscous, lumpy substance which tends to deposit accordingly between the water-cooled mould and the strand surface. This causes the formation of non-uniform steel surfaces containing pockets of this slaggy, foreign substance that must be ground smooth or otherwise conditioned before the steel can be further processed. This need presents a very severe cost penalty to the production of high quality steel products.

OBJECT OF THE INVENTION

It is therefore an object of the present invention to mitigate the tendency of the aluminum to increase the viscosity of the slag on the molten steel in the water-cooled moulds, and thereby to mitigate the external steel quality defects associated with plain aluminum feeding.

BRIEF SUMMARY OF THE INVENTION

According to the present invention, there is provided a method of continuously casting steel in an open-bottomed mould, including the steps of:

- continuously introducing molten steel into an open-bottomed mould;
- continuously introducing aluminum into the molten steel as the steel enters the mould; and continuously introducing into the molten steel as the steel enters the mould a metal oxide fluxing agent, selected from the group consisting of the oxides of manganese, silicon, boron and sodium, whereby slag upon formation in the steel floats to the surface of the molten steel and is fluidized.

Various metal oxides, other than that of aluminum, will tend to produce a fluxing agent. However, the oxides of manganese, silicon, boron and sodium are preferred for employment in the practice of the present invention because of their relatively low cost, ready availability and effectiveness in ability to flux viscous high aluminum-oxide slag.

It has been found that the fluxing agent fluidizes the viscous slag which forms when aluminum is fed into the molten stream. In practice, it has been found that this viscous slag turns very fluid but with some fluxing agents it can tend to float in spots on the molten steel as oil does on water. It has also been found that the frequency of billet defects can be even further reduced by reducing or even avoiding such fluid slag spots by the further addition of a glassy mixture containing silicon oxide and sodium oxide.

The fluxing agent may be supplied by any system which will provide a sufficiently uniform rate of supply of the fluxing agent to the steel. However, because of equipment congestion and limited space available around a caster, it is preferred to add the fluxing agent as a coating on the aluminum wire.

Also according to the present invention, there is provided a steel additive for use in the continuous casting of steel in an open-bottomed mould, which comprises aluminum provided, e.g. coated, with a fluxing agent which mitigates detrimental surface characteristics in the cast steel resulting from slag in the mould. It has been found that the use of metal oxide fluxing agents, e.g. the oxides of manganese, silicon, boron and sodium, maintains the fluidity of the mould slag and promotes a formation of smooth solid steel strand surfaces which do not require grinding. It is therefore possible, employing the present invention, to provide continuously cast steel strands, containing aluminum in quantities typical of ingot mould cast steel, that are comparatively devoid of the detrimental external quality characteristics related to plain aluminum feeding but which do provide the internal benefits typical of aluminum-treated steel.

BRIEF DESCRIPTION OF THE DRAWINGS

The present invention will be more readily understood from the following description of the embodiment thereof illustrated by way of example in the accompanying drawings, in which.

DESCRIPTION OF THE PREFERRED EMBODIMENT

Figure 1:
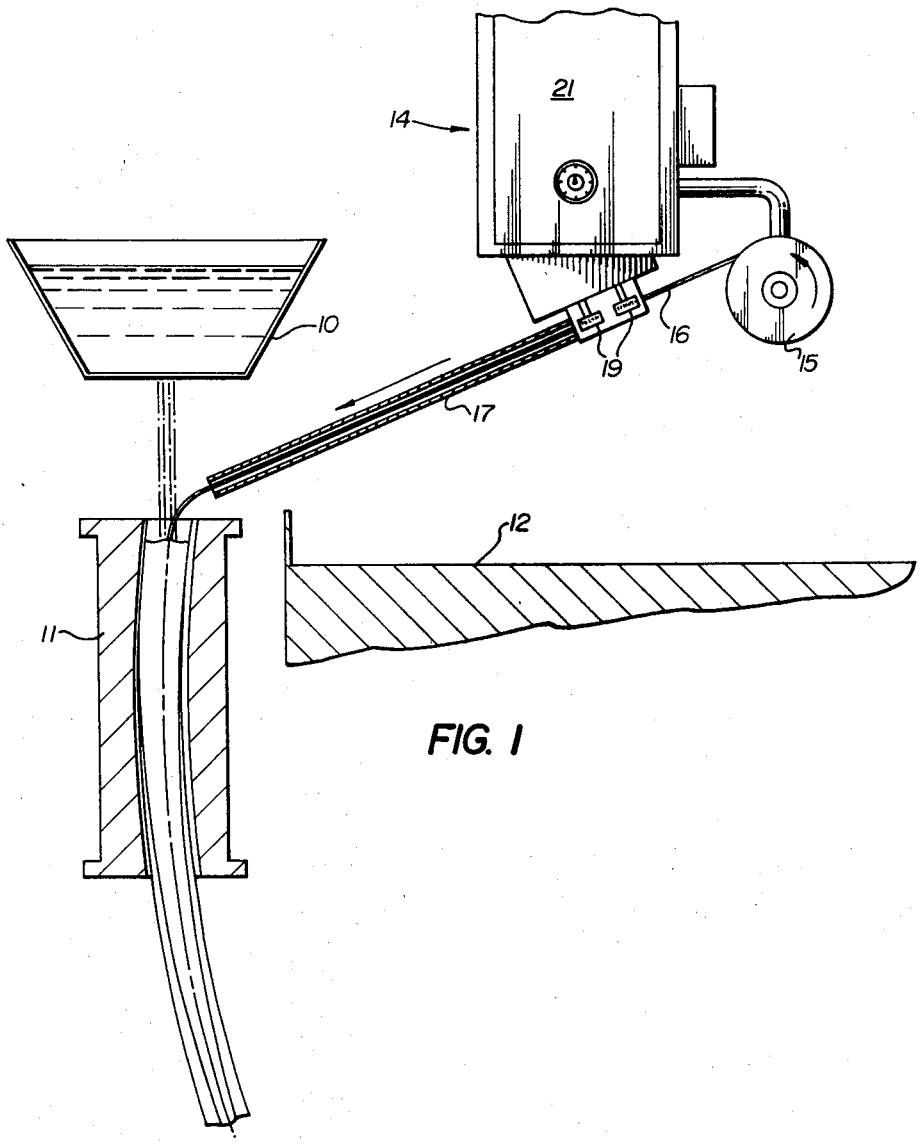
FIG. 1 shows a diagrammatic side view of apparatus for the continuous casting of steel.

The apparatus illustrated in FIG. 1 of the accompanying drawings has a tundish 10 for providing a flow of molten steel into the top of an open-bottomed mould assembly 11 disposed beneath the tundish 10.

The open-bottomed mould assembly 11 extends downwardly past a floor 12, above which there is mounted an aluminum wire feeding arrangement indicated generally by reference numeral 14.

The aluminum wire feeding arrangement 14 includes a supply spool 15 holding a coil of aluminum wire 16, and a wire guide tube 17 for guiding the aluminum wire 16 along a downwardly inclined path to the open upper end of the open-bottomed mould assembly 11.

For feeding the aluminum wire 16 from the supply spool 15, knurled drive wheels 19 are provided at opposite sides of the path of travel of the aluminum wire 16 for engaging and advancing the latter, the knurled drive wheels 19 being driven by an electric motor (not shown) accommodated in a housing 20 at the underside of a control unit 21, which is manually adjustable by an operator for controlling the speed of advance of the aluminum wire 16 towards the open-bottomed mould assembly.

As will be readily appreciated by those skilled in the art, the above-described wire feeding arrangement is of conventional construction and operation, and therefore need not be described in greater detail herein.

However, in accordance with the present invention, the aluminum wire 16 is provided with a coating of fluxing agent, which is described in greater detail hereinafter.

Figure 2:
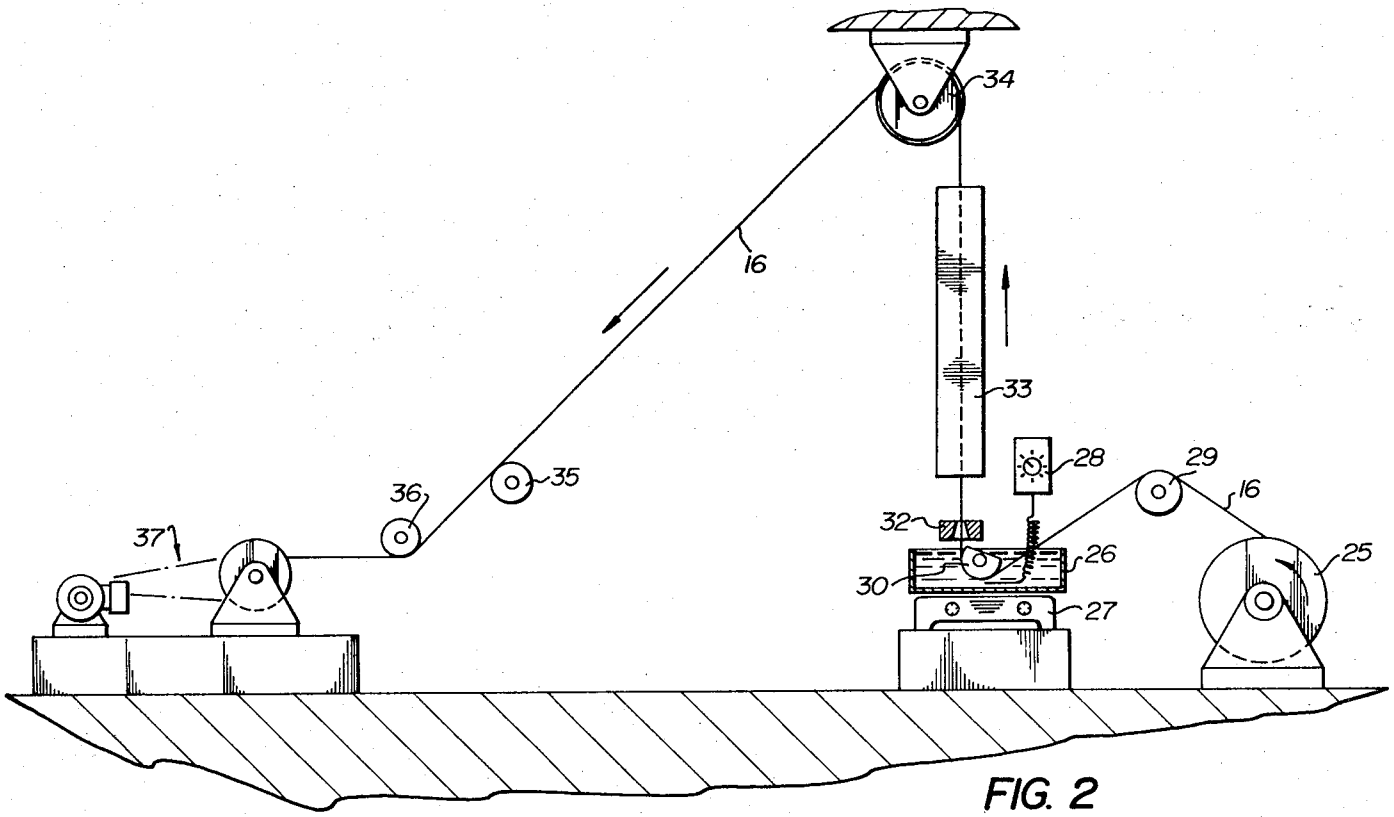
FIG. 2 shows a diagrammatic side view of apparatus for forming a coating of an aluminum wire.

This coating of fluxing agent is provided on the aluminum wire 16 by means of the wire coating apparatus illustrated in FIG. 2.

This apparatus has a supply spool 25 for holding a supply of uncoated aluminum wire.

The fluxing agent which is to be applied to the aluminum wire 16 is mixed with a hot, liquid glue or bonding agent and the mixture is contained in an open-topped container or flux pot 26, which is provided on an electric resistance heating unit 27.

The energization of the heating unit 27 is thermostatically controlled by means of a thermostat 28, which senses the temperature of the mixture in the flux pot 26 and which can be preset to de-energize the heating unit 27 when the temperature of the mixture reaches a predetermined value. A guide roller 29 is provided for guiding the aluminum wire from the supply spool 25 to a further guide member 30 in the flux pot 26.

From the guide member 30, the aluminum wire is led upwardly through an orifice plate 32 and a cooling chamber 33 to an overhead guide roller 34.

The orifice plate 32 determines the thickness of the coating of the mixture on the aluminum wire 16, and cooling chamber 33 cools and solidifies the coating as the aluminum wire 16 travels upwardly to the guide roller 34.

From the guide roller 34, the coated aluminum wire travels downwardly, past guide rollers 35 and 36, to a wire winding mechanism indicated generally by reference numeral 37, at which the wire is stored in the form of a coil on a take up spool.

As mentioned hereinabove, it has been found that the addition of a fluxing agent, together with the aluminum, into the open topped mould during the continuous casting operation reduces external defects on the cast steel.

The following Table sets out data quantifying the internal deficiencies of continuously cast steel that has not been treated with aluminum, together with corresponding results obtained in continuously cast steel containing plain aluminum additions and also in continuously cast steel to which the present coated aluminum wire has been added during the casting process. In particular this Table illustrates the effectiveness of the use of the coated aluminum wire in avoiding the detrimental influence on surface quality imparted by plain aluminum additions while maintaining the internal soundness achieved when aluminum is added to the steel.

TABLE

| Practice | Surface Quality Patches of Slag Large[1] | Small[2] | Internal Quality[3] Macro Slag Inclusions | Blow-holes | Pin-holes |
|---|---|---|---|---|---|
| Non-aluminum treated | 0 | 0 | 26 | 2 | 10 |
| Plain aluminum treated | 3 | 4 | 5 | 0 | 1 |
| Coated aluminum treated | 1 | 1 | 6 | 0 | 1 |

[1]number of large surface slag patches per 17 foot length of billet surface.
[2]number of small surface slag patches counted on 6 inch long laboratory-sized billet sample lengths.
[3]number of defects through a midway plane of a 6 inch long, 4 inch wide mid-way longitudinal billet face plus those on the adjacent 3 inch long, 4 inch wide transverse billet face.

Using manganese oxide coated aluminum wire, acceptable results have been obtained with wire comprising 6 to 15% manganese oxide and 94–85% aluminum. Preferably, the wire comprises at least 8% manganese oxide, and good results have been obtained with wire comprising 11% manganese oxide and 89% aluminum. Similar results have also been achieved with wire coatings comprised of 10% boron/sodium oxide (borax); 3% borax plus 7% glassy silicon/sodium oxide; and 3% borox plug 3% glassy silicon/sodium oxide plus 4% manganese oxide.

In practice, satisfactory results have been obtained employing an aluminum wire having a diameter of 0.093 inches and coated with a layer of manganese oxide having a thickness of 0.031 inches, this wire being supplied to the molten steel at a rate of approximately 100 feet of wire per ton of steel cast. The aluminum wire treated steel produced in this way has a normal aluminum content of 0.02 to 0.04%.

The weight of the glue or bonding agent employed to provide adhesion between the fluxing agent and the aluminum is not included in the above percentages, but normally approximated that of the fluxing agent.

I claim:

1. A method of continuously casting steel in a caster which does not employ a ceramic shroud which includes the step of:

continuously introducing molten steel into an open-bottomed mould; and continuously introducing aluminum in the form of a wire coated with a metal oxide fluxing agent into said molten steel as the latter enters the mould, said metal oxide fluxing agent consisting essentially of manganese oxide in an amount of 6% to 15% by weight based on the weight of the aluminum wire introduced, excluding the weight of bonding agent for said metal oxide fluxing agent; whereby alumina upon formation in the steel floats to the surface of the molten steel, is fluidized and is carried away from the surface of the molten steel between the mould and the cast steel.

2. A method as claimed in claim 1, wherein said fluxing agent and said aluminum are fed into the molten steel as an aluminum wire coated with said fluxing agent, said coated wire comprising 6 to 15% manganese oxide and 94–85% aluminum, excluding a bonding agent for the fluxing agent.

* * * * *